United States Patent [19]

Sakemi et al.

[11] Patent Number: 4,844,008

[45] Date of Patent: Jul. 4, 1989

[54] NON-CONTACT DEVELOPING APPARATUS UTILIZING A TANGENTIAL MAGNETIC FIELD

[75] Inventors: Yuji Sakemi, Yokohama; Katsumi Kurematsu, Kawasaki, both of Japan

[73] Assignee: Canon Kabushiki Kaisha, Tokyo, Japan

[21] Appl. No.: 69,301

[22] Filed: Jul. 1, 1987

[30] Foreign Application Priority Data

Jul. 3, 1986 [JP] Japan ..... 61-1551547
Jul. 26, 1986 [JP] Japan ..... 61-176162

[51] Int. Cl.[4] ..... G03G 15/09
[52] U.S. Cl. ..... 118/658; 355/253
[58] Field of Search ..... 118/657, 658; 355/3 DD

[56] References Cited

U.S. PATENT DOCUMENTS 4,292,387 9/1981 Kanbe et al. ..... 118/653 X
4,350,440 9/1982 Watanabe ..... 118/658 X
4,380,966 4/1983 Isaka ..... 118/657 X
4,395,476 7/1983 Kanbe et al. ..... 118/653 X
4,504,136 3/1985 Yoshikawa et al. ..... 355/3 DD
4,653,427 3/1987 Hosaka et al. ..... 118/658

*Primary Examiner*—Shrive Beck
*Assistant Examiner*—Alain Bashore
*Attorney, Agent, or Firm*—Fitzpatrick, Cella, Harper & Scinto

[57] ABSTRACT

A developing method and apparatus using toner particles and magnetic carrier particles includes disposing a developer carrying member in associated with a latent image bearing member for bearing an image to be developed so as to form a developing zone, providing stationary magnetic poles of different polarities behind the developer carrying member, providing developer regulating zone where a layer of the developer including a mixture of toner particles and magnetic carrier particles is formed on the developer carrying member with a regulated layer thickness, the developer regulating zone beam disposed between the magnetic poles along a surface of the developer carrying member and immediately upstream of the developing zone with respect to movement of the developer layer, and applying electric field between the latent image bearing member and the developer carrying member in the developing zone.

20 Claims, 6 Drawing Sheets

NON-CONTACT DEVELOPING APPARATUS UTILIZING A TANGENTIAL MAGNETIC FIELD

FIELD OF THE INVENTION AND RELATED ART

The present invention relates to a developing method and a developing apparatus wherein a tangential (in a tangential direction of a developer carrying member) magnetic field is formed between magnetic poles of different polarities, in a developing position preferably with application of an alternating electric field in the developing position, such as vibratory, AC-DC superimposed alternating field, a modified alternating electric field or a pulsed electric field.

U.S. Pat. Nos. 4,395,476; and 4,292,387 disclose a non-contact developing method wherein insulating and magnetic toner or non-magnetic toner is applied as a thin coating on a developer carrying member surface; the toner is brought to be opposed to a latent image bearing member with a clearance between the surface of the thin coating of the toner and the surface of the latent image bearing member; and an alternating electric field is applied in the developing zone to transfer the toner from the developer carrying member to the latent image bearing member to develop an electrostatic latent image on the latent image bearing member.

Such a developing method involves a problem that if an attempt is made to electrically charge with certainty each of the toner particles on the developer carrying member surface to an intended polarity, the thickness of the toner layer on the developer carrying member becomes so thin that a sufficiently high image density of the developed image is not provided when a solid black image is developed at a relatively high developing speed.

Japanese Laid-Open Patent Applications Nos. 32060/1980 and 153970/1980 disclose that two component developer containing carrier particles and toner particles is used with an electric field applied in the developing station, and they are known as good developing methods from the standpoint of improving an image quality and an image density. However, even with those developing methods, the state of the developer supplied to the developing position changes more or less when the developing speed is high, and insufficiency of the density of the toner image is observed when a solid black image is developed.

It has been found that the insufficient toner image density of the solid black image is remarkable when non-magnetic toner mainly consisting of resin is used than when magnetic toner containing resin and magnetic material is used. Therefore, it has been found that the problem is more serious in color development than in monochromatic development.

Particularly in the case of a pictorial color image with high quality of development, an edge effect and insufficient density of a solid image are significant problems.

If the thickness of the toner layer on the developer carrying member surface is increased, it becomes difficult to charge the toner to the intended polarity and to a satisfactory extent, particularly in the case of one component developer. The insufficient charge results in deposition of unnecessary toner to the non-image area and also in a poor quality toner image.

U.S. Pat. No. 4,653,427 and German Laid-Open patent application No. 3506311 have proposed an improvement in consideration of the above background.

U.S. Pat. No. 4,653,427 discloses a method of development wherein a developer carrying member, behind which magnetic field generating means is provided, carries on its surface a layer of developer which is a mixture of magnetic carrier particles each containing not less than 40% by weight of magnetic powder and non-magnetic toner particles mainly consisting of resin, wherein a portion of the developer carrying member between magnetic poles of the magnetic field generating means behind the developer carrying member is opposed to a latent image bearing member in a developing position, wherein a magnetic field strength in a tangential direction of the developer carrying member surface is set to be not less than 200 Gausses, wherein a clearance between the surface of the developer carrying member and the surface of the latent image bearing member is larger than the thickness of the developer layer, and an alternating electric field is formed across the layer, the method comprising a step of transferring the non-magnetic particles from the developer layer on the developer carrying member to the latent image bearing member both at image and non-image areas and a step of transferring back unnecessary non-magnetic particles to the developer carrying member, wherein those steps are alternated. With this method, a high quality image development usable for pictorial color development can be provided with little edge effect, sufficient solid black image density and uniform density. Additionally, it is another advantage of this method that the magnetic particles are not transferred to the latent image bearing member even if the alternating electric field is applied to the developing position, and therefore, clear color image quality can be provided with stability.

In this method, however, if the development clearance is further increased in an attempt to make it larger than the thickness of the developer layer, the electric field across the clearance has to be increased in order to obtain a sufficient density of development, which, however, results in easier occurrences of electric leakage between electrodes. If the thickness of the developer layer is decreased as an alternative method for the same purpose, the developer tends to agglomerate in a zone where the developer is confined for the purpose of formation of the thin layer, and therefore, considerable experiments are required to reach appropriate developing conditions to provide stabilized images for a long period of time.

Further, if the particle size of the developer is reduced to not more than 7 microns on the average in an attempt to accomplish high quality and high speed image formation, sufficient image density is not obtained through the developing method described above. When the strength of the alternating electric field is increased for the purpose of solving this problem, the magnetic carrier particles begin to be transferred and deposited onto the surface of the electrostatic latent image bearing member, with the result that the toner content in the developer container varies significantly, so that the density of the developed image can not be controlled.

Furthermore, when the developing speed is increased, it is necessary to increase the rotational speed of the sleeve, that is, the developer carrying member in order to increase the image density. In this case however, the centrifugal force increases with the increase of the rotational speed so that the carrier particles are more easily deposited onto the latent image bearing member.

German patent No. 3,506,311 proposes that a developer confining plate is disposed immediately before the developing position. According to this method, such a sufficient amount of toner can be supplied as to provide a developer layer having a thickness less than the development clearance at the developing position and as to provide proper image density of the solid black image. Accordingly, satisfactory images can be provided at an initial stage of the developing operation. However, since the structure is not stable due to the provision of the confining plate downstream of a developer regulating member, long period image forming operation results in stagnated developer between the regulating member and the confining plate. Therefore, the toner can agglomerate, because of which white stripes appear in a developed image.

U.S. Pat. Nos. 4,350,440; 4,504,136 disclose that a developer containing magnetic particles are supplied to a developing position to which a tangential magnetic field and alternating electric field are imparted.

U.S. Pat. No. 4,577,992, for example discloses carrier particles and toner particles usable for the non-contact developing method using two component developer.

U.S. Pat. No. 4,380,966 discloses a regulating member disposed downstream of a magnetic pole.

However, those patents are not directed to a solution to the problems described above.

SUMMARY OF THE INVENTION

Accordingly, it is a principal object of the present invention to provide a developing method and a developing apparatus wherein when an image is developed with a developer containing magnetic particles, a surface of the developer in the developing zone is made uniform and stabilized to further enhance the developing action by the alternating electric field and further to prevent unnecessary magnetic particles from being deposited on the latent image bearing member.

It is another object of the present invention to provide a developing method and a developing apparatus wherein an edge effect is minimized, and a solid black image can be developed into a high density and high quality image for a long period of time of operation.

It is another object of the present invention to provide a developing method and a developing apparatus wherein a solid image can be produced at such a high quality and high sharpness as to be sufficiently applicable to pictorial color images for a long period of time and wherein the developing operation can be effected at high speed.

It is a further object of the present invention to provide a developing method and developing apparatus which is usable with small size toner particles (not more than 7 microns) and capable of providing high quality images, wherein loss of the carrier particles is prevented.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 9:
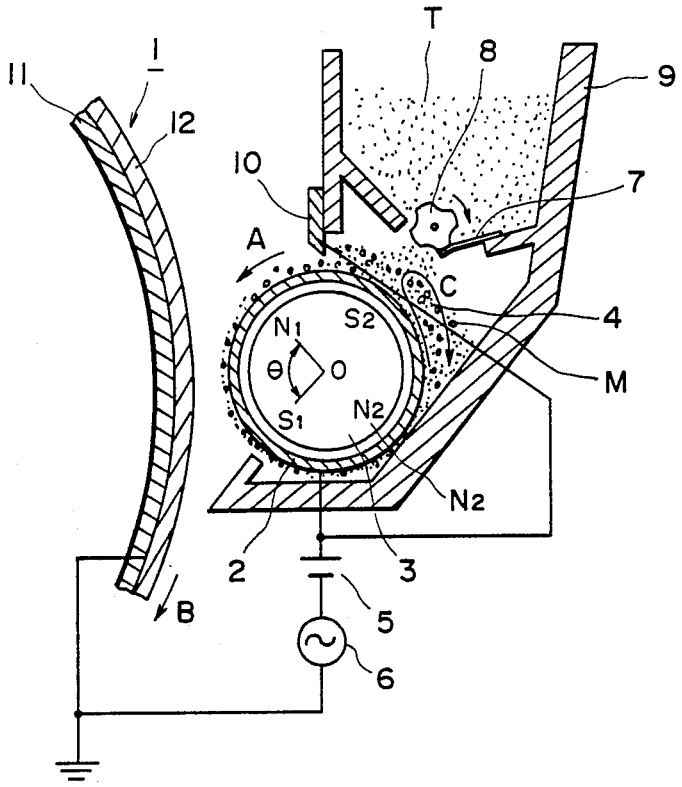
FIG. 9 is a sectional view of a developing apparatus for illustrating problems underlying the present invention.
Figure 10:
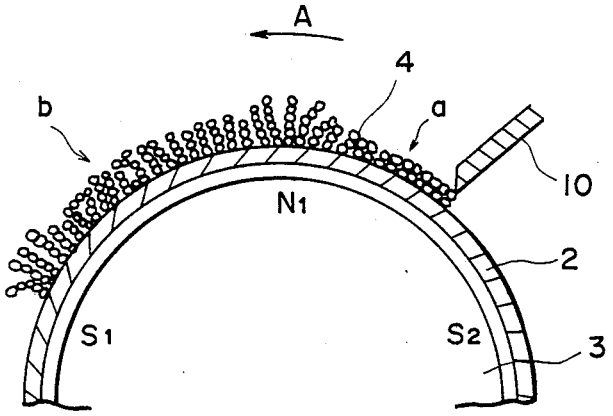
FIG. 10 illustrates a layer of developer in the device of FIG. 9.

Referring to FIGS. 9 and 10, the description will be first made as to the problems underlying the present invention for the purpose of a better understanding of the present invention.

In FIG. 9, reference numeral 1 designates an electrostatic latent image bearing member for bearing a latent image to be developed, which comprises a back electrode 11 and an electrostatic latent image bearing layer 12 on the electrode 11. The bearing layer may be an insulating layer or an electrophotographic photosensitive layer. In this example, it is shown as a photosensitive drum 1.

A developer carrying member 2 for carrying a developer is made of non-magnetic material and is a sleeve of an electrically conductive material rotatable in the direction indicated by an arrow A in this example. Inside the sleeve, magnetic field generating means 3 is fixed to a frame of the apparatus. It is a magnet roller having four magnetic poles in this example. Developer 4 contains magnetic particles (carrier) each containing magnetic powder and resin and the developer 4 also contains non-magnetic particles (toner) mainly consisting of resin and having average particle size smaller than that of the magnetic particles, as a mixture. Between the sleeve 2 and the back electrode 11 of the photosensitive drum rotatable in the direction indicated by an arrow B, a developing bias voltage is applied from a DC source 5 and an AC source 6. The developing device further comprises an elastic member 7, toner supplying roller 8 and a regulating member 10 for regulating the thickness of a layer of the developer on the sleeve 2. The regulating member 7 is in the form of a doctor blade in this example.

The sleeve 2 is disposed opposed to the surface of the photosensitive drum 1 with a clearance of 200–800 microns, preferably 300–600 microns therefrom.

A toner supplying roller 8 having plural recesses in the periphery rotates slowly together with rotation of a driving gear of the sleeve 2 meshed with a driving gear for the photosensitive drum 1, so as to supply little by little the non-magnetic particles (toner) T from a hopper 9 to a developing chamber therebelow with the aid of the plastic member 7.

The toner T supplied to the developing chamber is mixed with magnetic particles M (particles containing resin and magnetic powder therein) existing in the neighborhood of the sleeve 2 containing therein the magnet roller 3. When the sleeve 2 rotates in the direction of the arrow A, the developer on the sleeve surface moves in the manner indicated by an arrow C, whereby the supplied toner is gradually mixed into the inside of developer 4.

The doctor blade is made of non-magnetic material and is disposed opposed to the surface of the sleeve 2 with a clearance of approximately 100–550 microns, preferably 150–450 microns at a portion between a north (N) pole N1 and a south (S) pole S1. The developer 4 mixed in the above-described manner is applied on the surface of the sleeve 2, having a regulated thickness, for example 100–600 microns, preferably 150–500 microns. The thickness of the developer layer is less than the clearance between the photosensitive drum 1 and the sleeve 2 in a developing zone or position, so that the developer layer is out of contact with the surface of the photosensitive drum when the apparatus is not operated.

The non-magnetic particles (toner) T in the developer 4 applied on the sleeve 2 are triboelectrically charged by friction with the sleeve 2 and with the magnetic particles M, and are retained by the electrostatic force between the sleeve 2 rotating in the direction of an arrow A and by an electrostatic force between the magnetic particles, so that the non-magnetic particles, together with the magnetic particles, are brought to the developing zone on the sleeve 2 by the sleeve's rotation.

In the developing zone, what is opposed to the photosensitive drum 1 is a portion of the sleeve 2 which is between the N-pole N1 and the S-pole S1 of the magnet roller 3 therein. Due to this arrangement, the developer on the surface of the sleeve 2 is not erected, and therefore, a uniform layer of developer is formed in the developing zone.

Figure 2:
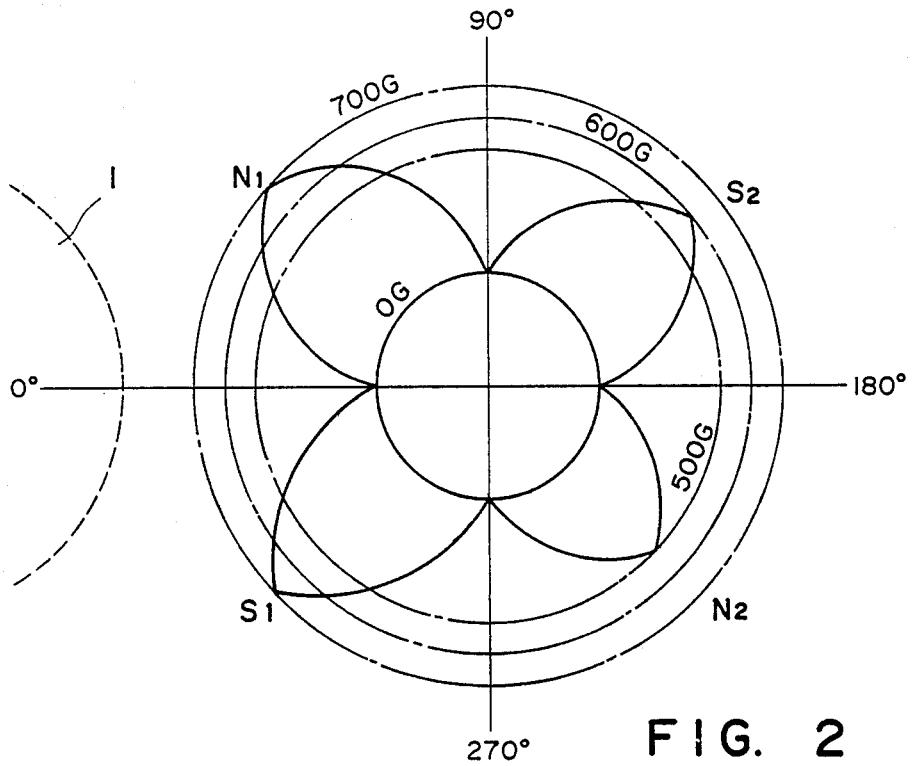
FIG. 2 is a diagram indicating a distribution of radial direction magnetic field component on a developing speed of a magnet roll used in the developing apparatus of FIG. 1.

With this structure, it is noted that the developer having passed through the clearance between the doctor blade 10 and the sleeve 2 once passes by a pole position (N1) and is then conveyed to the developing position which is between the poles N1 and S1. Since the regulated developer is passed by the pole position, the developer is erected at the pole position by the magnetic field formed by the magnetic pole so that the developer is loosened. By this, the density of the developer layer becomes low, with the result that even if it becomes unerected by the magnetic field after it is further conveyed, the thickness of the developer layer becomes larger than that before it passes by the pole position (N1). This is shown in FIG. 2, wherein the same reference numerals are assigned to the corresponding elements. At a position a, the thickness of the developer layer is substantially equal to the clearance between the blade 10 and the surface of the sleeve 2, but after the layer has passed by the pole position (N1), the thickness of the developer layer is larger for the reasons described above. The thickness of the layer at this time depends on the material of the carrier particles, however normally the thickness is approximately doubled. Therefore, if one tries to obtain not more than 400 microns of the layer thickness at the developing position, it is required that the clearance between the blade and the sleeve is set not more than 200 microns. If, however, the blade-sleeve clearance is reduced to such an extent, the load applied to the developer in the clearance becomes so large that where low softening temperature toner (polystyrene or the like) is used, the toner is fused on the carrier, resulting in carrier deterioration, or otherwise, the toner agglomerates, resulting in white stripes appearing in the developed image.

Figure 1:
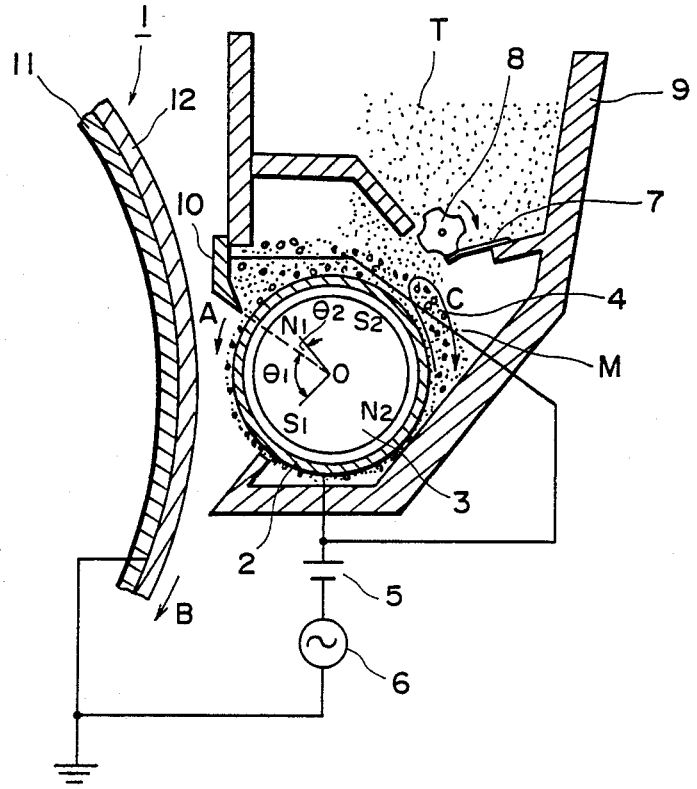
FIG. 1 is a sectional view of a developing apparatus according to an embodiment of the present invention.

Referring now to FIG. 1, there is shown a developing device according to an embodiment of the present invention wherein the problems are solved.

The same reference numerals are assigned as in FIG. 9 to the corresponding elements. The feature of this embodiment is in that both the blade 10 and the developing position zone are between the two magnetic poles. Due to this arrangement, the thickness of the developer layer at the developing position can be made substantially equal to the blade-sleeve clearance, and therefore, even if the blade-sleeve clearance is set not less than 200 microns, proper developing conditions can be provided, and no white stripe or foggy background due to carrier deterioration results. It is preferable that the position of the blade 10 is not less than 5 degrees away toward the developing position away from the pole position (a point where a radial (radial direction of the sleeve, that is, normal to the sleeve surface) component of the magnetic field provided by the magnetic pole N1 is maximum or a point at which the radial component starts to decrease from the maximum), that is, an angle $\theta 2$ is not less than 5 degrees in FIG. 1. If the blade 10 is opposed exactly to the magnetic pole N1, the blade-sleeve clearance has to be not more than 200 microns in order to obtain a proper thin layer, since the developer layer is loosened for the same reason as described above, therefore, the stabilized image can not be obtained for a long period of time. This has been confirmed.

Where the regulating blade 10 and the developing position are both between the two magnetic poles, the sleeve 2 can be placed closer to the drum 1 in the developing zone, whereby clear image quality can be provided due to the developing electrode effect. It has been confirmed that if the drum-sleeve clearance is larger than about 1 mm, unclear images are formed.

At the time of development, an alternating electric field is formed in the developing zone by applying an alternating voltage between the sleeve 2 and the back electrode 11 of the photosensitive drum 1. The alternating voltage is produced by superimposing a DC voltage by a DC power source 5 to a alternating voltage by the AC power source 6. It is most preferable that a bias voltage is applied between the sleeve 2 and the photosensitive drum 1. Additionally, it is preferable that to maintain an equal electric potential level between the sleeve 2 and the regulating blade 10. It :s possible to use an AC voltage only, as the bias. It is not necessary that the AC voltage is a sine wave, and it may be a pulse wave. The peak-to-peak voltage Vpp of the alternating current is preferably 200 V–4 KV, and the frequency is preferably 100 V–4 KHz.

EXAMPLE 1

With the developing apparatus described in conjunction with FIG. 1, the development was actually carried out for an electrostatic latent image having a dark potential Vd of +600 V and a background area potential Vl of 0 V. The developing bias voltage applied was provided by superimposing a DC voltage of 150 +V with an AC voltage having a frequency of 1.6 KHz and the peak-to-peak voltage of 2200 Vpp. The non-magnetic particles used were toner particles having the volume average particle size of approximately 5 microns containing as a main component a thermoplastic resin (polystyrene). The non-magnetic particles were negatively chargeable with respect to the magnetic particles. If positively chargeable toner particles are used, a reverse development can be carried out, if the DC voltage is selected suitably. The magnetic particles were obtained by kneading resin material containing as a main component styrene-acryl-aminoacryl copolymer and 75% by weight of magnetic powder of magnetite ($Fe_3O_4$), and then pulverizing it into particles having a number average particle size of 50 microns. Better images were provided, when not more than 1% by weight of silica particles are mixed into the above-described two component developer, the silica particles having a position in the series of electrostatic charge between the positions of the two particles of the developer.

When the above-described bias voltage is applied, and the potential of the sleeve 2 exceeds a threshold in the negative voltage phase, the non-magnetic particles negatively charged are moved across the clearance from the developer layer on the sleeve 2 to the surface of the photosensitive drum 1 at least in the position where the drum 1 and the sleeve 2 are closest, irrespective of whether it is the image area or the non-image area (the background of the image). However, in the phase of the opposite polarity, at least the excessive non-magnetic particles move back to the sleeve 2. These steps are repeated a plurality of times, and then, the movement fades out with the reduction of the alternative electric field together with the increase of the clearance between the drum 1 and the sleeve 2, thus terminating the developing action. In order to reduce the alternating electric field, the voltage applied may be decreased.

The distance between the surfaces of the photosensitive drum 1 and the sleeve 2 is preferably close enough to avoid production of unsharp images. When a magnetic pole is opposed to the drum 1 in the developing zone, it is difficult to reduce the clearance between the surfaces of the drum 1 and the sleeve 2, because the developer is formed into an erect brush.

For this reason, it is preferable that in the developing zone the drum is opposed to a sleeve portion between adjacent magnetic poles (N1 and S1) of the magnet roller so as to permit the setting of the drum-sleeve clearance to be 200–800 microns, preferably 300–600 microns.

FIG. 2 shows a distribution of the magnetic field provided by the magnet roller 3. This FIGURE shows the distribution of the radial component of the magnetic field (the strength of the magnetic pole) which is generally used to express the strength of the magnetic field on the sleeve 2 surface. In this FIGURE, the position of 0 degree corresponds to the line, which is horizontal in this embodiment, connecting the center of the drum 1 and that of the sleeve 2. The radial component is a component of the magnetic field extending in a direction normal to the sleeve 2 surface. FIG. 2 shows the distribution of such around the entire sleeve surface. It will be understood that the magnetic field is 0 Gauss at a point between the magnetic poles N1 and S1. Experiments showed that the magnetic particles (carrier particles) were magnetically confined on the sleeve 2 even at the position between the magnetic poles and substantially untransferred to the drum 1. This would not be easily understood from FIG. 2 only.

Figure 3:
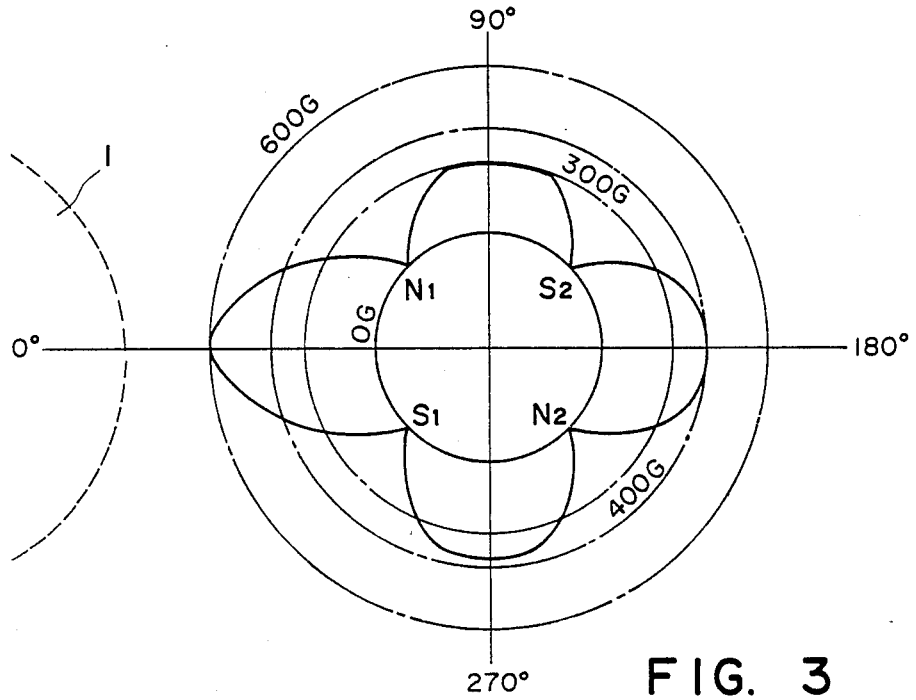
FIG. 3 is a diagram indicating a distribution of a tangential direction magnetic field component on the surface of the sleeve of the magnet roll of the developing apparatus shown in FIG. 1.

However, it is readily understood referring to FIG. 3 which shows the distribution of the tangential component of the magnetic field on the sleeve surface, using the same coordinate axes. In this embodiment, the tangential component was 600 Gausses between the magnetic poles N1 and S1. It has been confirmed by various experiments that a good quality images are provided if the tangential component is not less than 200 Gausses, preferably not less than 300 Gausses. This is because the magnetic particles are hardly deposited onto the drum 1 when the magnetic field is not less than 200 Gausses. If it is less than that, the magnetic particles tend to be deposited onto the drum surface, and therefore, it is required that the particle size of the magnetic particles be increased, which results in a decreased concentration of the toner-magnetic particles, whereby the difficulty results in the concentration control. Furthermore, the developer layer becomes thicker, and therefore, the drum-sleeve clearance has to be increased which leads to unsharp images.

As described, by opposing the position between the magnetic poles to the drum, magnetic particles are effectively and substantially prevented from transferring to the surface of the drum 1, and also the necessity of increasing the drum-sleeve clearance can be eliminated, the increase being necessitated in order to avoid the influence of the erect magnetic brush and necessarily resulting in an unsharp image. For this reason, the above-described conditions are preferable in this embodiment.

Table 1 identifies satisfactory conditions of the magnetic particles to produce a good image quality without foggy background in a stabilized manner.

TABLE 1

| AVERAGE PARTICLE SIZE (μm) | MAGNETIC POWDER CONTENT (wt. %) 70 | 60 | 50 | 40 | 30 |
|---|---|---|---|---|---|
| 30 | F | N | N | N | N |
| 40 | G | F | N | N | N |
| 50 | G | F | F | N | N |
| 60 | G | G | F | N | N |
| 70 | G | G | F | N | N |
| 80 | G | G | F | F | N |
| 90 | F | F | F | F | N |
| 100 | F | F | F | F | N |

G: Good
F: Fair
N: Not Practical

In this Table "N" means not practical, "F" practically usable, and "G" more preferable. When the weight average particle size is less than 30 microns, the magnetic particles transfer to the photosensitive drum 1, which is not practically usable. In the range of the weight average particle size of 80–100 microns, it is practically usable if the magnetic powder content is not less than 40 wt. %. Exceeding 100 microns, the preferable content of the non-magnetic particles in the developer approaches 10 wt. %, so that the mixture ratio becomes not so different from that of conventional two component developer, which requires strict control of the mixture ratio.

It follows that the weight average particle size of the magnetic particles is preferably not less than 30 microns, more preferably not less than 40 microns but not more than 100 microns, further preferably not less than 40 microns but not more than 80 microns. And, the magnetic powder content of the magnetic particle is preferably not less than 40 wt. %. A magnetic particle entirely composed of magnetic material is usable. A magnetic particle formed by a core of magnetic material and a coating therearound of a resin is also usable. This is advantageous since it can be easily formed into a spherical shape and can be uniformly charged triboelectrically. A charge controlling agent which may be pigment or dye may be mixed into the resin constituting the magnetic particle so as to ensure that the non-magnetic particle (toner) particles are charged in the intended polarity and to the intended amount of charge, thus providing a high quality of images. The developed images with high image density and without a foggy background could be obtained in the broad range of the mixture ratio of the toner particles and magnetic particles, 10–40 wt. %. Because of this broadness, the control of the toner concentration is easier, which is of course advantageous. If the mixture ratio is less than 15 wt. %, the density of the developed image is low while if it is more than 45 wt. %, the background fog results.

In the description of this embodiment of FIG. 1, the sleeve has been rotated in the direction of the arrow A, however, good images were also obtained when it was rotated in the opposite direction. To rotate the sleeve in the opposite direction rather than the direction of the arrow A was found to be effective to increase the image density in a high speed developing operation.

Regarding the magnetic retention or confinement of the magnetic particles, the relation will be described between the strength of the tangential component of the magnetic field on the sleeve surface between the magnetic poles in the developing zone and the radial component thereof on the sleeve surface at the position of the two magnetic poles (N1 and S1). A stronger radial component of the magnetic field on the sleeve surface at the positions of the magnetic poles, does not necessarily lead to a stronger tangential component of the magnetic field at the position between the magnetic poles. If the two magnetic poles are too distant, the tangential component on the sleeve surface at a position between the magnetic poles is reduced, too. On the contrary, if the two magnetic poles are too close, the area between the magnetic poles is narrow, resulting in a narrow proper developing zone, and in addition, the strength of the tangential component of the magnetic field of the sleeve surface is not increased much.

In consideration of these, the angle $\theta$ formed between a line connecting the center of the magnetic roller 3 (which is the center of the sleeve 2) and one of the magnetic poles (N1) and a line connecting the center of the magnet roller 3 and the other magnetic pole (S1), preferably satisfies the relation 45 degrees$\leqq\theta\leqq$135 degrees.

In order to stably obtain a high quality of images, the weight average particle size Dt of the non-magnetic particles (toner) preferably satisfies $$Dt \leqq Dc \leqq 30\ Dt$$

where Dc is the weight average particle size of the magnetic particles. If the particle size of the non-magnetic particles is too large as compared with the particle size of the magnetic particles, the non-magnetic particles are insufficiently charged triboelectrically. If it is too small on the contrary, a poor quality of images results.

Further, the non-contact development according to this invention can use toner having an average particle size of 1–20 microns, and therefore it is possible to use toner having a particle size not more than 5 microns, which can provide sharp and clear images.

As described in the foregoing, a high quality of images can be provided stably for a long period of time by a simple structure wherein both of the developer regulating member and the developing position are disposed between two magnetic poles.

Figure 4:
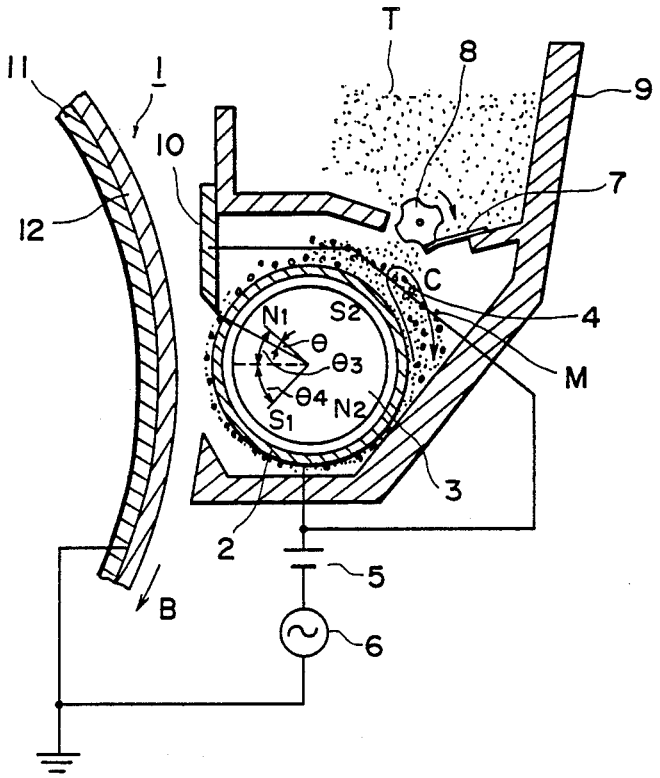
FIG. 4 is a sectional view of a developing apparatus according to another embodiment.
Figure 5:
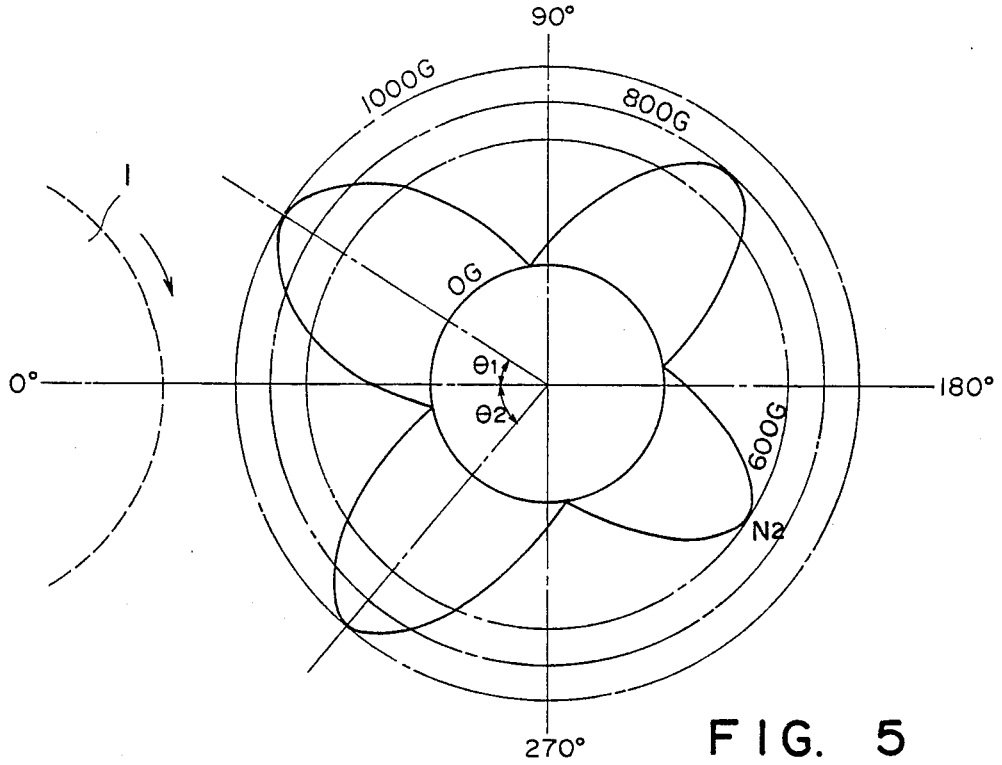
FIG. 5 shows a distribution of a radial direction magnetic field component on a sleeve surface of a magnet roll in the developing apparatus shown in FIG. 4.
Figure 6:
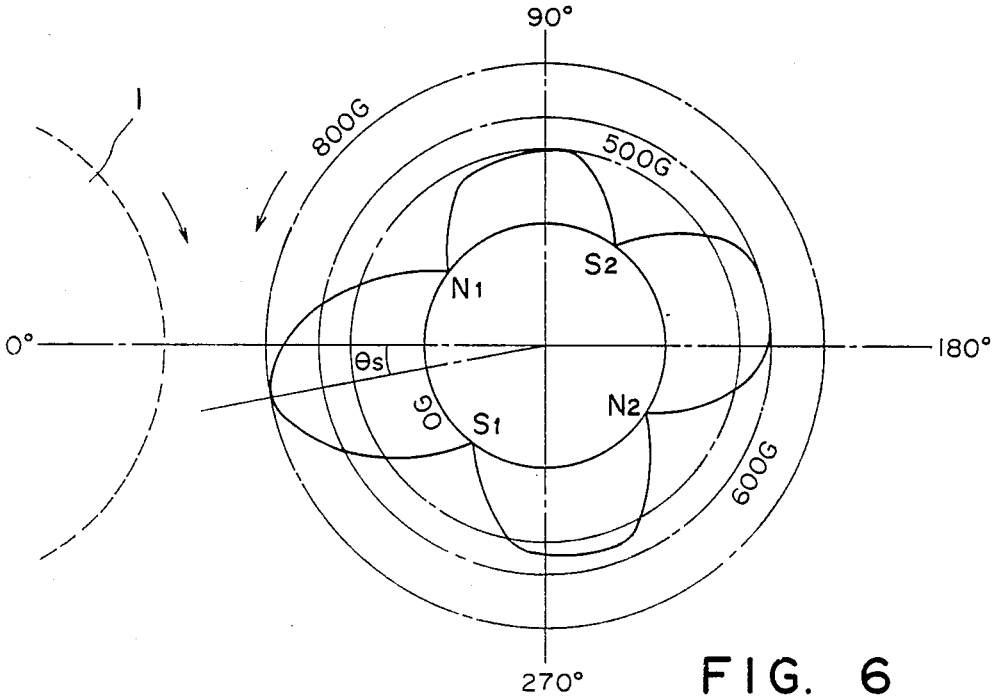
FIG. 6 shows a distribution of a tangential direction magnetic field component on the surface of the sleeve of the magnet roll in the developing apparatus in FIG. 4.

Referring to FIGS. 4–6, a further improvement will be described. This is also related to the structure wherein the development is effected between two magnetic poles having different polarities with an application of a vibratory electric field. The improvement is in that the average particle size of the toner particles is not more than 7 microns; the average particle size of the magnetic particles is not less than 10 microns and not more than 60 microns; a maximum magnetic field strength in the radial or normal direction by the magnetic pole producing the tangential electric field is not less than 800 Gausses at the developing position; a maximum magnetic field strength in the tangential direction is not less than 700 Gausses on the developer carrying member surface at the developing position; the position of the maximum magnetic field strength in the tangential direction is adjacent to the developing position; and the magnetic field strength distribution is such that the tangential magnetic field strength monotonously decreases upstream and downstream of the maximum position.

According to this embodiment, the magnetic particles are prevented from being transferred and deposited to the electrostatic latent image bearing member even if the developer carrying member is rotated at a high speed for the purpose of high speed development; the magnetic particles are prevented from being transferred and deposited to the latent image bearing member even if the strength of the alternating electric field is increased; and a high quality image can be provided at a high speed and without foggy background.

The conditions to be satisfied in this embodiment will be further described.

The inventors have found that if the particle size of the toner particles is decreased, more particularly decreased to not more than 7 microns on the volume average, the toner particles forming the image properly correspond to the potential of the latent image so as to remove the foggy background, and more particularly if it is not less than 4 microns and not more than 6 microns, a very good image can be provided under the application of the alternating electric field and using two component developer, without fog, and the quality of the resultant image is close to that of conventional printing. However, in this case, in order to maintain the image density, the peak voltage of the alternating electric field is required to be 1.5–2 times the level when usual 10 micron toner is used. If this is done, good images can be provided. With his high bias voltage, however, the magnetic particles are more easily transferred to the drum, with the result that after the developing operation is performed for a long period of time, the magnetic particles on the drum damage the surface thereof to produce voids in the resultant image, and the amount of the carrier particles in the developing device changes unintentionally. Therefore, even if the desirable toner particles are used, it in not possible to effectively enjoy the advantages. On the contrary, the developer content control does not work well, and therefore, a foggy background results. This improved embodiment provides a solution to these problems.

FIG. 4 shows the structure of the developing apparatus of the embodiment. Since this embodiment is similar to the first embodiment, detailed explanation is omitted for the sake of simplicity by assigning the same reference numerals and characters to the corresponding elements and parts, and the portion which is different from the first embodiment will be described.

In this embodiment, in order to make the developer layer uniform, the developer regulating position of the doctor blade 10 is away toward the developing position from the center of the upstream magnetic pole position by an angle $\theta$ (FIG. 4) which is not less than 5 degrees.

To satisfy these conditions, N-pole N1 (the position of the maximum radial component of the magnetic field (the strength of the magnetic field or the magnetic flux density in that direction) by the magnetic pole N1 is away from the position where the sleeve 2 is closest to the latent image bearing member, toward upstream with respect to rotation of the sleeve 2 by an angle $\theta 3$) and S-pole S1 (the position of the radial component of the magnetic field provided thereby is away from the closest position toward downstream by an angle $\theta 4$) are preferably spaced apart from each other by not less than 45 degrees ($\theta 1+\theta 2 \geqq 45$ degrees), more preferably not less than 60 degrees.

When toner particles having the average particle size of not more than 7 microns are used, and an alternating bias source providing the voltage of 1.5– 2 times the normal voltage is used in order to provide the sufficient image density, it has been found that the tangential component of the magnetic field on the sleeve surface at the developing position is preferably not less than 700 Gausses, more preferably not less than 800 Gausses in order to perform satisfactory development in consideration of the centrifugal force at the time of high speed development. In order to accomplish this, it has been found through various experiments that the radial components of the magnetic field on the sleeve surface at the magnetic poles N1 and S1 are preferably not less than 800 Gausses, more preferably not less than 900 Gausses. If the tangential component is less than the above, the carrier particles are transferred and are deposited on the drum surface with the result that the image is disturbed, that the balance between the carrier and toner in the developing device is disturbed to produce a foggy background, and that the drum is damaged by the carrier, thus reducing the durability. It is, therefore, understood that the above parameters are significant.

It is extremely expensive if not impossible to produce an isotropic magnet so as to satisfy these conditions. Additionally, in the case of a small sized developing device, a desired magnetic pole arrangement can not be obtained. In view of this, it is possible to produce a desired magnetic force by planting an aeolotropic magnet into the isotropic magnet. If this is done, however, the radial component of the magnetic field is concentrated on the pole position, and therefore, the transportation of the developer adjacent the developing position is not satisfactory, and the toner layer made uniform at the developing position is disturbed slightly in some cases. Since the inventors have found this, they have further investigated this problem and finally found preferable conditions to avoid it.

FIG. 5 shows a magnetic field distribution on the magnetic roll using a planted aeolotropic magnet, usable with the FIG. 4 structure. The strength of the magnetic field is represented as a magnetic field component in the radial direction (the strength of the magnetic pole), which is ordinarily used to express the strength of the magnetic field on the sleeve surface. In this FIGURE, the position of 0 degree corresponds to the line, which is horizontal in this embodiment, connecting the center of the drum and that of the sleeve (the drum and sleeve are closest on this line). The radial or normal component is the component of the magnetic field extending perpendicular to the surface of the sleeve, and FIG. 5 shows the distribution thereof all around the sleeve surface. It will be noted that the magnetic field is 0 Gauss at a point between the magnetic pole N1 and the magnetic pole S1. In the distribution of the tangential component of the magnetic field in FIG. 6, there is only one local maximum point of the tangential component between the magnetic poles N1 and S1, and the developing position or zone is located in the region where the tangential component monotonously decreases. This is preferable in that a magnetic field confining zone is established where the developer passing through the developing position is strongly induced from the developing position along the sleeve surface.

If two local maximum points are formed in the region between the magnetic poles, resulting in formation of a local minimum point, the tangential component distribution of the magnetic field substantially becomes in the form of a wave in the neighborhood of the developing position. Then, the developer on the sleeve tends to be strongly attracted to the local minimum point, and therefore, when the sleeve is rotated to convey the developer, the developer jumps from the local maximum point of the horizontal component of the magnetic force upstream of the developing position with respect to a direction of the developer transportation to the local maximum point downstream thereof. This is why the slight and subtle disturbance of the developer is introduced at the developing position. Those have been found by the inventors. As a result of a number of experiments, the inventors have further found that in order to produce a developer layer which is further smooth and uniform at the developing position, only one local maximum point of the tangential magnetic force is formed, and it is to be located adjacent the developing position, and also the tangential component monotonously decreases at the upstream and downstream sides to the pole positions. The maximum point of the monotonously changing distribution of the tangential magnetic field is located out of the closest position between the sleeve and the drum which is the developing position in this embodiment. This is because then, the magnetic carrier particles which tend to be deposited on the surface of the drum can be strongly confined.

It will be understood that a good developing operation can be achieved by the structure of a developing device providing the distribution of the radial component of the magnetic field as shown in FIG. 5 and the distribution of the tangential component of the magnetic field shown in FIG. 6. More particularly, the good development operation contains formation of a uniform developer layer at the developing position, no deposition of the carrier particles onto the drum after development, a high quality image of high resolution formed stably for a long period of time. Those conditions providing strong magnetic force and satisfactory developer conveying property are not easily satisfied by usual magnetization to an isotropic magnet. However, the inventors have found that it can be quite easily produced by bonding aeolotropic magnet sheets to constitute a magnet to be located in the sleeve.

In order to provide good conveying property and to achieve prevention of the carrier from being deposited onto the drum, the tangential and radial components of the magnetic force are required to be strong, but it will suffice if the maximum of the tangential component monotonously decreases toward upstream and downstream adjacent the developing position, the maximum is not necessarily in the form of a point but may have more or less width. This has been confirmed by the inventors.

EXAMPLE 2

The development was actually carried out under the same conditions as Example 1 with the exception of the following. The peak-to-peak voltage was 2200 Vpp, and the non-magnetic particles were toner particles having the particle size distribution shown in FIG. 7 containing as a main component a thermoplastic resin (polystyrene) and were negatively chargeable with respect to the magnetic particles.

In this Example, the sleeve-drum clearance was 300 microns, while the developer layer thickness was 200 microns in the developing zone. The used magnet was such as to provide the radial and tangential magnetic force distribution as shown in FIGS. 5 and 6 on the developing sleeve surface. When the development was carried out with the use of the above-described bias voltage, good images without fog were stably produced.

A modification was made by using magnetic particles containing resin material and magnetic powder therein having the same average particle size, and it was confirmed that good images were also produced.

Also, images of high developed image density were produced without foggy background with a very wide range of toner/magnetic particle mixture ratio, as wide as 15–45 wt. %. As will be understood, therefore, the toner content control is easier. If the mixture ratio is less than 15 wt. %, the image density of the developed image becomes low, while when it is more than 45 wt. %, a foggy background result.

In the foregoing description, the sleeve 2 has been rotated in the direction of an arrow A. However, it may be rotated in the opposite direction. And it has been confirmed that good images are also produced.

EXAMPLE 3

Figure 7:
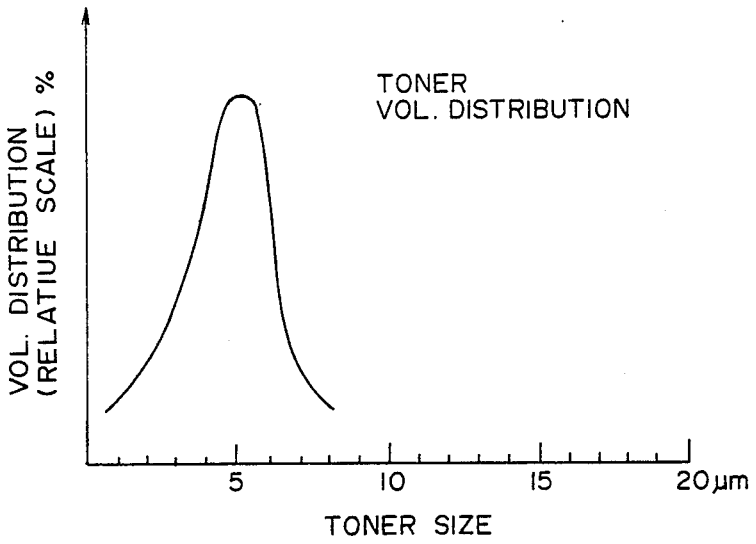
FIG. 7 shows particle size distribution of toner particles which can provide a high quality image in the developing apparatus and method according to the present invention.
Figure 8:
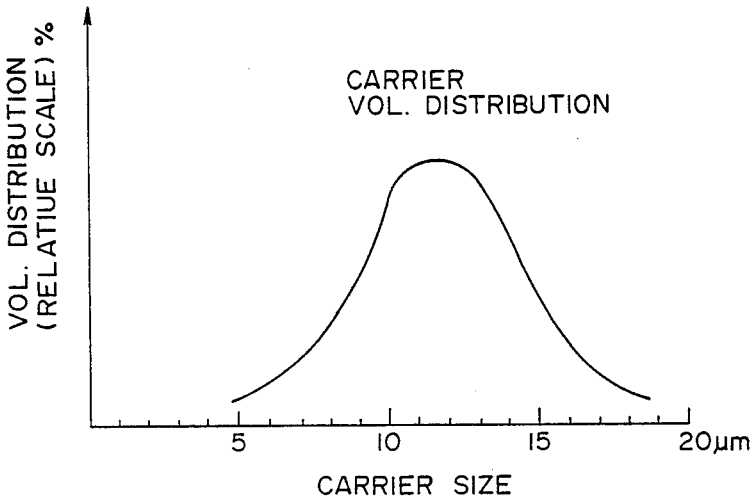
FIG. 8 shows a particle size distribution of carrier particles usable with the toner of FIG. 7.

The clearance between the photosensitive drum 1 and the sleeve 2 was set to be 300 microns, and the thickness of the developer layer was regulated by the doctor blade so as to provide 200 microns at the position where it was closest to the photosensitive drum. The developer was prepared by mixing non-magnetic particles and magnetic particles so as to provide the particle size distribution as shown in FIGS. 7 and 8. The content of the non-magnetic particles was 15 wt. %. The content of the magnetic powder in a magnetic particle was 70 %, and the average particle size of the magnetic particles was 50 microns. The arrangement of the magnetic particles was the same as with Example 2.

The developed electrostatic latent image had a dark area potential Vb of −600 V and a background area potential Vl of 0 V. The non-magnetic particles (toner) was positively chargeable. The developing bias voltage applied was obtained by superimposing a DC voltage of −150 V to an AD voltage having the frequency of 1.6 KHz and the peak-to-peak voltage of 1800 Vpp. It was confirmed that only non-magnetic particles were transferred to the dark portion, whereas none of the non-magnetic particles and magnetic particles were deposited on the non-image area (light area), that is, without fog.

Because of the small particle size of the toner, the proper mixture ratio of the toner and magnetic particles changes to 10% by weight–25% by weight. The proper value of the mixture ratio is properly determined by one skilled in the art on the basis of the ratio of the particle sizes of the toner and magnetic particles.

Since the small particle size developer is used, the image was very fine, and the resolution is very high as in a conventional printing. Although the bias voltage is high, the magnetic force is also strong so that the carrier particles are not deposited onto the drum, and therefore, fine images are stably provided for a long period of time.

As described in the foregoing, the magnetic field strengths in the radial directions at the pole positions of the magnetic field generating means are all not less than 800 Gausses, and the magnetic field strength in the tangential direction on the developer carrying member at the developing position is not less than 700 Gausses, whereby the magnetic particles are effectively prevented from being deposited onto the drum, and the stabilized and good images are produced at high speed even if the size of the toner particles is small. Further, the position of the maximum of the magnetic field strength is adjacent the developing position, and the magnetic field strength monotonously decreases upstream and downstream toward pole positions, so that a uniform developer layer is maintained at the developing position, and a good image is produced without trace of sweep.

The toner regulating position of the regulating member, together with the position where the image bearing member and the developer carrying member are closest in the developing zone, are located in the tangential magnetic field formed between magnetic poles of different polarities along the surface of the sleeve, whereby the surface of the developer layer is maintained uniform over a long period. From this standpoint, the present invention is applicable to all developing methods with the advantage of enhancing the quality of the developed image, irrespective of whether or not the developing bias is used, whether AC or DC bias is used and whether the developer is a two-component developer or whether it is a one-component magnetic developer.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image on a movable latent image bearing member;

a developer carrying sleeve rotatable through a developing zone including a position where said developer carrying sleeve is closest to the latent image bearing member;

a developer container for supplying to said developer carrying sleeve a developer including magnetic carrier particles and toner particles;

a first magnetic field generating portion for providing a maximum magnetic flux density of a magnetic field component in a direction normal to a surface of the developer carrying sleeve at a position upstream of said closest position with respect to a direction of rotation of said developer carrying sleeve;

a second magnetic field generating portion adjacent to said first magnetic field generating portion and having a polarity different from that of said first magnetic field generating portion for providing a maximum magnetic flux density of a magnetic field component normal to the developer carrying sleeve surface at a position downstream of said closest position with respect to the direction of rotation of said developer carrying sleeve;

a member for regulating a thickness of the developer layer on said developer carrying sleeve in a developer regulating zone, said member being located between said closest position and the position of the maximum magnetic flux density by said first magnetic field generating means; and means for forming an alternating electric field in the developing zone between the latent image bearing member and said developer carrying sleeve;

wherein said first and second magnetic field generating portions are cooperative to form a magnetic field component tangential to said developer carrying sleeve surface in the developing zone.

2. An apparatus according to claim 1, wherein an angle seen from a rotational axis of said developer carrying sleeve formed between a position of the maximum magnetic flux density by said first magnetic field generating portion to said developer layer regulating zone is not less than 5 degrees

3. An apparatus according to claim 1, wherein the closest position is in a range where a normal component of the magnetic field by said magnetic field generating portion exists.

4. An apparatus according to claim 1 wherein a maximum tangential magnetic field flux density in the developing zone is not less than 700 Gausses on the surface of the developer carrying sleeve.

5. An apparatus according to claim 4, wherein the maximum magnetic flux densities by said first and second magnetic field generating portions are not less than 800 Gausses.

6. An apparatus according to claim 1, wherein the magnetic particles are resin coated magnetic carrier particles for carrying the toner particles, and wherein said first and second magnetic field generating portions produce force in a direction to remove the magnetic carrier particles from the latent image bearing member.

7. A developing apparatus for developing a latent image on a movable latent image bearing member;

a developer carrying sleeve movable through a developing zone including a position where said developer carrying sleeve is closest to the latent image bearing member;

a developer container for supplying to said developer carrying sleeve a developer including magnetic carrier particles and toner particles;

a first magnetic field generating portion for providing a maximum magnetic flux density of a magnetic field component in a direction normal to a surface of the developer carrying sleeve at a position upstream of said closest position with respect to a direction of movement of said developer carrying sleeve;

a second magnetic field generating portion adjacent to said first magnetic field generating portion and having a polarity different from that of said first magnetic field generating portion for providing a maximum magnetic flux density of a magnetic field component normal to the developer carrying sleeve surface at a position downstream of said closest position with respect to the direction of movement of said developer sleeve carrying sleeve; and;

a member for regulating a thickness of the developer layer on said developer carrying sleeve in a developer regulating zone, said member being located between said closest position of the maximum magnetic flux density by said first magnetic field generating means;

wherein said first and second magnetic field generating means are cooperative to form a magnetic field tangential to said developer carrying sleeve surface in the developing zone.

8. An apparatus according to claim 1 or 2, wherein said regulating member forms the developer layer having a thickness smaller than the clearance between the image bearing member and the sleeve at the position where they are closest.

9. An apparatus according to claim 8, wherein the clearance between the regulating member and the sleeve is not less than 100 microns and not more than 550 microns.

10. An apparatus according to claim 8, wherein the regulating member is disposed adjacent a developer outlet of the container.

11. An apparatus according to claim 8, wherein said container supplies to the sleeve a developer containing toner particles having an average particle size of not more than 7 microns and carrier particles having an average particle size of not less than 10 microns and not more than 60 microns.

12. An apparatus according to claim 7, wherein an angle seen from a rotational axis of said developer carrying sleeve formed between a position of the maximum magnetic flux density by said first magnetic field generating portion to said developer layer regulating zone is not less than 5 degrees.

13. An apparatus according to claim 7, wherein the closest position is in a range where a normal component of the magnetic field by said magnetic field generating portion exists.

14. An apparatus according to claim 7, wherein a maximum tangential magnetic field flux density in the developing zone is not less than 700 Gausses on the surface of the developer carrying sleeve.

15. An apparatus according to claim 14, wherein the maximum magnetic flux densities by said first and second magnetic field generating portions are not less than 800 Gausses.

16. An apparatus according to claim 7, wherein the magnetic particles are resin coated magnetic carrier particles for carrying the toner particles, and wherein said first and second magnetic field portions produce force in a direction to remove the magnetic carrier particles from the latent image bearing member.

17. An apparatus according to claim 7 or 12, wherein said regulating member forms a developing layer having a thickness smaller than the clearance between the image bearing member and the sleeve at the position where they are closest.

18. An apparatus according to claim 17, wherein the clearance between the regulating member and the sleeve is not less than 100 microns and not more than 550 microns.

19. An apparatus according to claim 17, wherein the regulating member is disposed adjacent a developer outlet of the container.

20. Apparatus according to claim 17, wherein said container supplies to the sleeve a developer containing toner particles having an average particle size of not more than 7 microns and carrier particles having an average particle size of not less than 10 microns and not more than 60 microns.

* * * * *

UNITED STATES PATENT AND TRADEMARK OFFICE

CERTIFICATE OF CORRECTION

PATENT NO. : 4,844,008

DATED : July 4, 1989

INVENTOR(S) : YUJI SAKEMI, ET AL.

It is certified that error appears in the above-identified patent and that said Letters Patent is hereby corrected as shown below:

ON TITLE PAGE:

IN [57] ABSTRACT

Line 3, "associated" should read --association--.

COLUMN 3

Line 23, "U.S. Pat. No. 4,577,992," should read --U.S. Pat. No. 4,557,992,--.

COLUMN 5

Line 60, "FIG. 2," should read --FIG. 10,--.

COLUMN 6

Line 59, "It :s" should read --It is--.

COLUMN 7

Line 4, "150 +V" should read --+150V--.

COLUMN 8

Line 66, "of conventional" should read --of a conventional--.

UNITED STATES PATENT AND TRADEMARK OFFICE

CERTIFICATE OF CORRECTION

PATENT NO. : 4,844,008

DATED : July 4, 1989

INVENTOR(S) : YUJI SAKEMI, ET AL.

It is certified that error appears in the above-identified patent and that said Letters Patent is hereby corrected as shown below:

COLUMN 10

Line 63, "his" should read --this--.

COLUMN 11

Line 10, "detailed" should read --a detailed--.

COLUMN 13

Line 50, "result." should read --results.--.

COLUMN 14

Line 41, "toward" should read --toward the--.

COLUMN 15

Line 43, "5 degrees" should read --5 degrees.--.
Line 48, "claim 1" should read --claim 1,--.

UNITED STATES PATENT AND TRADEMARK OFFICE

CERTIFICATE OF CORRECTION

PATENT NO. : 4,844,008

DATED : July 4, 1989

INVENTOR(S) : YUJI SAKEMI, ET AL.

It is certified that error appears in the above-identified patent and that said Letters Patent is hereby corrected as shown below:

COLUMN 17

Line 2, "field portions" should read --field generating portions--.

Signed and Sealed this

Eighth Day of October, 1991

*Attest:*

HARRY F. MANBECK, JR.

*Attesting Officer*

*Commissioner of Patents and Trademarks*